US012540510B2

(12) United States Patent
Besic et al.

(10) Patent No.: US 12,540,510 B2
(45) Date of Patent: Feb. 3, 2026

(54) MAST ELEMENT, IN PARTICULAR LEADER ELEMENT, FOR A CONSTRUCTION MACHINE AND METHOD OF MANUFACTURING THE MAST ELEMENT

(71) Applicant: BAUER Maschinen GmbH, Schrobenhausen (DE)

(72) Inventors: Esef Besic, Burgheim (DE); Matthias Knoll, Thierhaupten (DE); Christian Miehling, Titting (DE); Rudolf Pöckl, Schrobenhausen (DE); Alexander Weigl, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 68 days.

(21) Appl. No.: 18/556,051

(22) PCT Filed: Apr. 28, 2022

(86) PCT No.: PCT/EP2022/061333
§ 371 (c)(1),
(2) Date: Oct. 18, 2023

(87) PCT Pub. No.: WO2022/243001
PCT Pub. Date: Nov. 24, 2022

(65) Prior Publication Data

US 2024/0209689 A1 Jun. 27, 2024

(30) Foreign Application Priority Data

May 19, 2021 (EP) ..... 21174764

(51) Int. Cl.
*E21B 7/02* (2006.01)

(52) U.S. Cl.
CPC ..... *E21B 7/023* (2013.01)

(58) Field of Classification Search
USPC ..... 173/184
See application file for complete search history.

(56) References Cited

U.S. PATENT DOCUMENTS

2004/0188118 A1 9/2004 Mcphee et al.
2013/0341036 A1* 12/2013 Flusche ..... E21B 19/20 166/85.5

FOREIGN PATENT DOCUMENTS

CN 111691419 A 9/2020
EP 0548900 A2 6/1993
EP 2520756 B1 7/2013

OTHER PUBLICATIONS

International Search Report issued in PCT/EP2022/061333; mailed Aug. 25, 2022.

(Continued)

*Primary Examiner* — Chinyere J Rushing-Tucker
(74) *Attorney, Agent, or Firm* — Studebaker Brackett PLLC

(57) ABSTRACT

The Invention relates to a mast element, in particular leader element, for a construction machine, with an elongate, hollow mast profile, which is approximately rectangular in cross section and comprises a linear guide for a mast carriage on its outer side along a longitudinal direction of the mast. In addition, according to the invention, at least one diagonal reinforcement element extends within the mast profile along the longitudinal direction of the mast, which is arranged at an oblique angle to the sides of the approximately rectangular mast profile.

12 Claims, 2 Drawing Sheets

(56) References Cited

OTHER PUBLICATIONS

Figure 1:
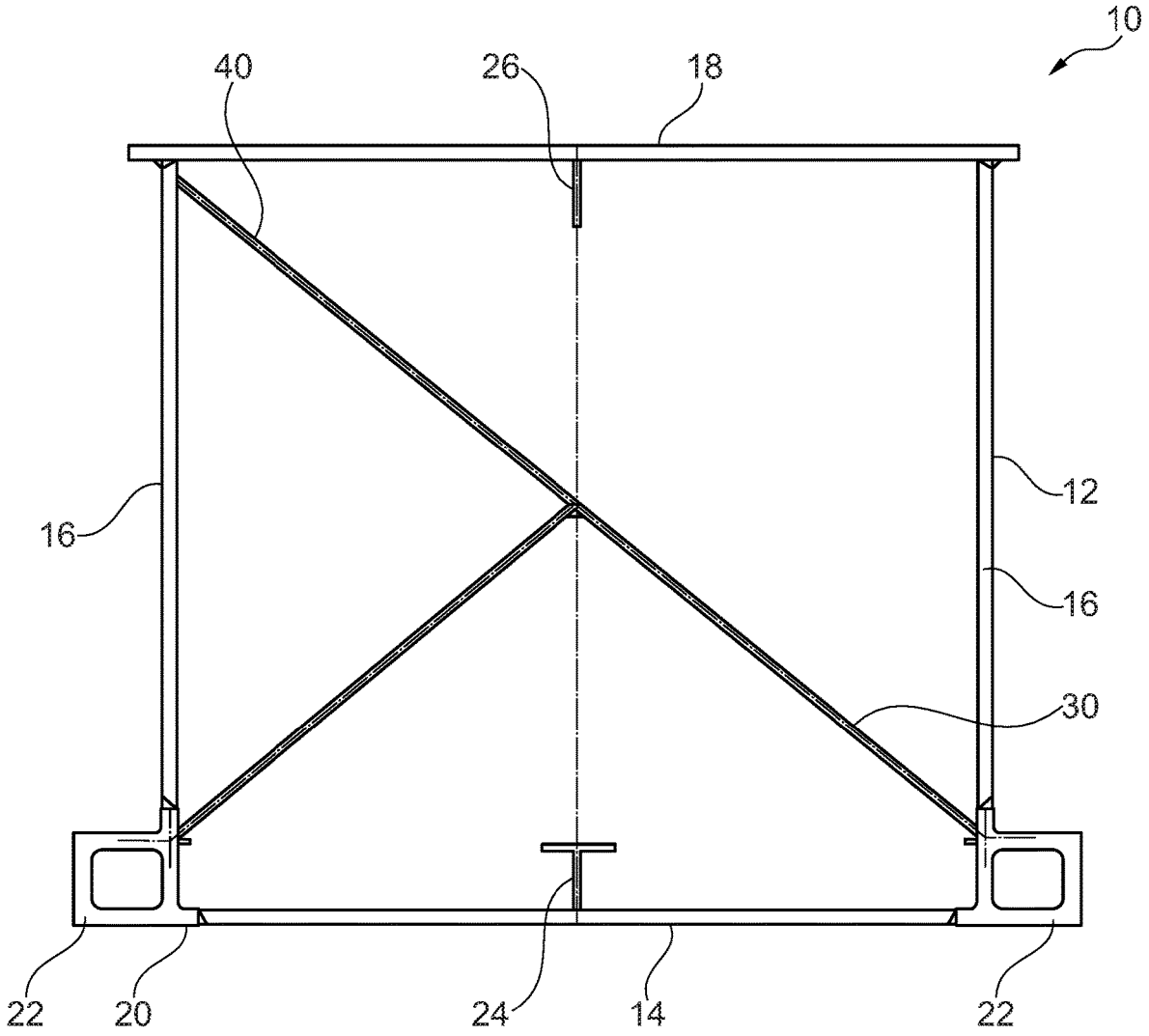

International Preliminary Report On Patentability (Chapter I) and Written Opinion of the International Searching Authority issued in PCT/EP2022/061333; issued Nov. 21, 2023.

* cited by examiner

MAST ELEMENT, IN PARTICULAR LEADER ELEMENT, FOR A CONSTRUCTION MACHINE AND METHOD OF MANUFACTURING THE MAST ELEMENT

The invention relates to a mast element, in particular a leader element, for a construction machine, with an elongate, hollow mast profile, which is approximately rectangular in cross-section and comprises a linear guide for a mast carriage on its outer side along a longitudinal direction of the mast, according to the preamble of claim 1.

The invention further relates to a method of manufacturing a mast element, according to claim 12.

Such mast elements are known, in particular as masts for earth drilling equipment, which are used, for example, for the construction of foundation piles. Such mast elements, which are essentially vertically oriented in operation, typically have a length of several meters up to about 30 meters. Along a front side of the mast element, which is often also referred to as a leader, a linear guide is provided for a mast or working carriage. A drilling drive for an earth drilling rig, for example, can be arranged on this working carriage.

The mast elements must have a high rigidity with the lowest possible weight in order to ensure reliable guidance on the one hand and to keep low a center of gravity of the overall device for good tilt stability on the other hand. It is known to use an approximately rectangular hollow profile for such mast elements. Such a tubular hollow profile can be manufactured as a seamless hollow profile or a U-profile from a steel material. To stiffen such mast profiles, it is known to divide the mast profile into segments of several meters in length and to weld a transversely directed stiffening plate, which is also referred to as a mast bulkhead, between the segments. A U-profile can be closed by welding on a cover plate.

In order to apply not only an external weld seam but also an internal seam to such bulkhead plates, it is necessary to make access holes, so-called hand holes, into the mast profile in the area of the bulkhead so that a welder can carry out a weld between the hollow mast profile and the bulkhead plate on the inside of the hollow mast profile. This is complicated and very time and labor consuming. Welding of the bulkhead plates can also be omitted, but this has a disadvantageous effect on the stiffness of the mast.

Further stiffening of such a mast element can be achieved by additionally welding elongated guide rails to the outside. These serve to form the longitudinal mast guide for a mast carriage and at the same time these form an additional stiffening element on the outside.

EP 2 520 756 B1 discloses a mast element with an elongated tubular body made of a fiber composite material. Processing fiber composites is time-consuming and costly. Joining to steel materials is difficult and requires special joining methods.

The object underlying the invention is to provide a mast element and a method of manufacture with which a particularly high rigidity can be achieved with efficient and cost-effective manufacturability.

According to the invention, the object is achieved by a mast element having the features of Claim 1 and a method having the features of Claim 12. Preferred embodiments of the invention are indicated in the dependent claims.

The mast element according to the invention is characterized in that at least one diagonal reinforcement element extends within the mast profile along the longitudinal direction of the mast, which is arranged at an oblique angle to the sides of the approximately rectangular mast profile.

A basic idea of the invention can be considered the provision of a reinforcement element inside the hollow mast profile, which extends diagonally to the sides of the mast profile, i.e. at an oblique angle to the inner sides of the approximately rectangular profile, for stiffening purposes. The oblique angle differs from a right angle. The reinforcement element extends in the longitudinal direction of the mast over at least one or more partial areas, preferably over the entire length of the mast element. Such internal diagonal stiffening can provide a substantial increase in the stiffness of the mast profile with respect to bending transverse to the longitudinal direction and torsional stiffness at a relatively low additional weight. The corner areas of the mast profile may be rounded or have beveled surfaces. With the same side length, the rectangular profile can also be approximately square.

In principle, the reinforcement element can be connected to the outer mast profile in any suitable manner, such as screw-connected. A preferred embodiment of the invention is that the at least one reinforcement element is welded along an inner side of the mast profile. Welding represents a reliable and cost-effective connection between metal materials. In this case, the weld seam runs along the longitudinal direction of the mast.

According to a further development of the invention, it is particularly advantageous that the at least one reinforcement element is welded along at least two side edges to preferably opposite walls of the mast profile. The diagonal reinforcement element, which may also be referred to as a stiffening element, may preferably extend diagonally through the hollow mast profile from one corner area to an opposite corner area. In principle, two or more reinforcement elements may also be provided within the mast profile. Several reinforcement elements may also be arranged, for example in a V, X or Y arrangement.

According to a further embodiment variant of the invention, particularly efficient stiffening can be achieved by the at least one reinforcement element comprising a plate-shaped metal sheet or a folded metal sheet. Such reinforcement elements can be manufactured at low cost. A bent sheet, which may have an L-shape, a C-shape or a Z-shape in cross-section, provides an additional increase in torsional stiffness compared to a flat metal sheet plate.

According to a further development of the invention, a particularly high stiffening is achieved in particular by the fact that several reinforcement elements are firmly attached, in particular welded, along the inner side of the mast. The several reinforcement elements can be arranged and welded both offset in the longitudinal direction of the axis and directly next to each other within the mast profile. The reinforcement elements can also be welded together at their butt joints.

In principle, the reinforcement element can be a continuous plate element. A particularly preferred embodiment of the invention is that the at least one reinforcement element has recesses to reduce weight. These recesses can be, for example, circular disc-shaped notches in central regions of the plate-shaped reinforcement element. In this way, a noticeable weight reduction of the reinforcement element can be achieved while maintaining good stiffness.

According to a further development of the invention, it is advantageous for good manufacturability of the mast element that the mast profile is formed by connecting at least two elongate mast parts, wherein connecting joints of the mast parts extend in the longitudinal direction of the mast. For example, a stiffening element can first be welded to a first mast part that is L-shaped or C-shaped in cross-section along the longitudinal direction of the mast. Subsequently, a second longitudinal mast part can be welded to the first mast part along the longitudinal direction of the mast to close the hollow mast profile, so that overall the stiffened hollow mast profile can be efficiently formed. Continuous welds or spot welds can be provided. Alternatively or additionally, screw joints and/or tongue-and-groove joints can be provided.

In particular, it is advantageous that the at least one reinforcement element is welded to at least one elongate mast part before the hollow mast profile is closed peripherally by welding on the last elongate mast part. This permits particularly simple manufacturability, wherein the weld seams can also be produced by welding robots.

In principle, the mast element according to the invention can be used or attached to a wide variety of equipment and installations, either alone or in combination with other mast elements. In particular, the invention comprises a construction machine, in particular a civil engineering machine, comprising a carrier device and a mast attached thereto, wherein the mast comprises at least one mast element according to the invention.

A particularly stiff mast is required, especially for construction machines with mobile carriers, although at the same time the mast must not move the overall center of gravity of the construction machine too far upwards in order to ensure sufficient stability and tilt resistance of the construction machine. This can be achieved particularly well with the mast element according to the invention.

According to a further development, it is particularly advantageous that the mast is configured as a leader, in particular a telescopic leader. A leader is basically a vertical mast with at least one linear guide, in particular for a working carriage. In the case of a telescopic leader mast, a second mast element is guided along the linear guide of a first mast element so as to be linearly slidable. A linear guide for the working carriage can also be arranged on the second mast element. A telescopic leader formed in this way allows the two mast elements to be moved telescopically relative to each other so that a relatively high overall mast can be achieved during operation.

The invention further comprises a method of manufacturing a mast element according to the invention, wherein during or after the formation of the hollow mast profile in a longitudinal direction of the mast within the mast profile the at least one diagonal reinforcement element is attached.

Particularly preferably, the mast profile is assembled, in particular welded together, from two or more elongated mast parts, each of which extends over the length of the mast element. The mast elements can be elongated sheet metal plates or sheet metal profiles. At least before welding the last mast part to enclose the hollow mast profile, the at least one reinforcement element is inserted and preferably welded longitudinally to the inner sides of the still open mast profile. This can be done easily and efficiently. Subsequently, the mast profile can be attached, in particular welded, overleaf to form the closed hollow mast profile.

Figure 2:
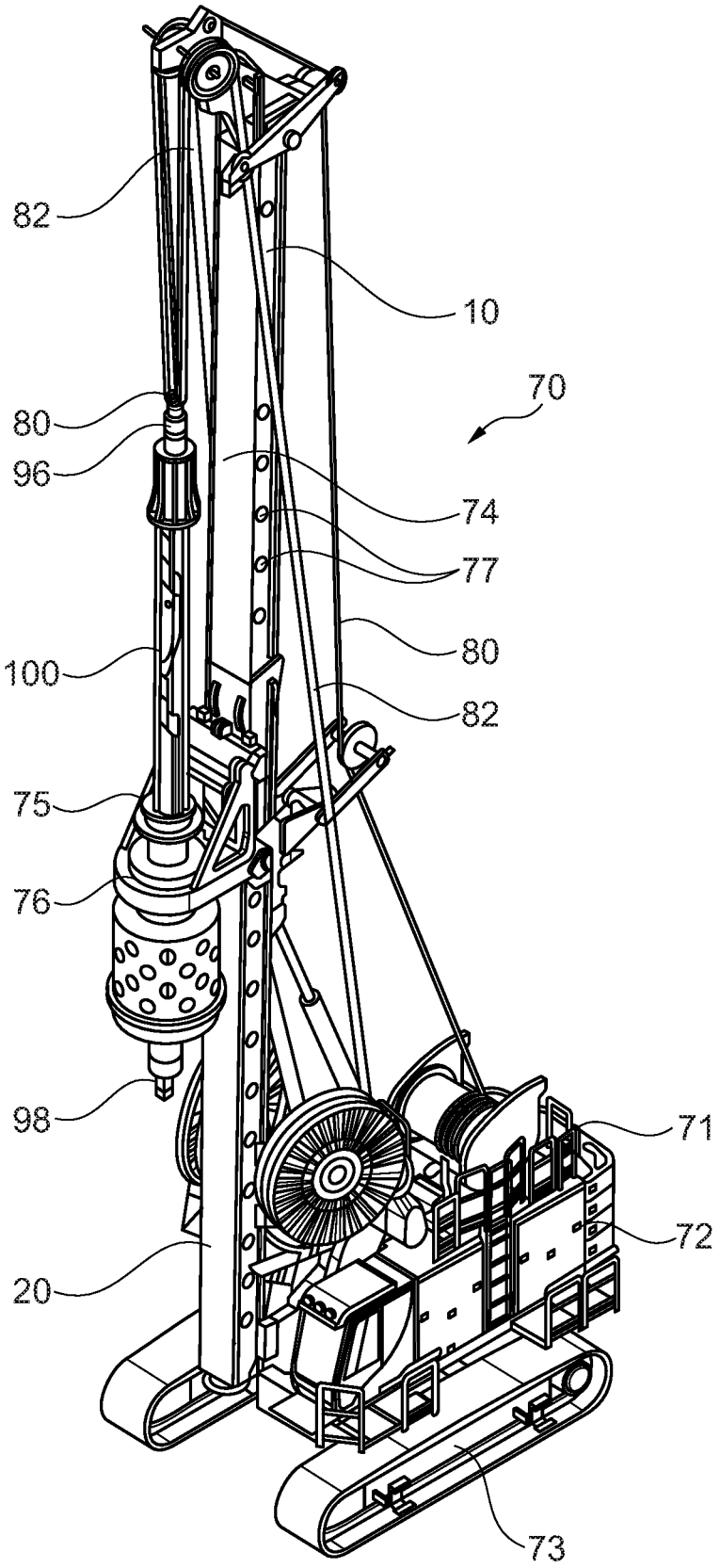

The invention is further described below with reference to preferred embodiments, which are shown in the drawings. The drawings show in:

FIG. 1 a schematic cross-sectional view through a mast element according to the invention; and FIG. 2 a perspective view of a construction machine according to the invention.

FIG. 1 shows a schematic cross-sectional view through a mast element 10 according to the invention, which is substantially formed by an outer hollow mast profile 12. The mast profile 12 may be composed of and welded to various mast parts or walls, which extend in a longitudinal direction of the mast. The longitudinal direction of the mast runs perpendicular to the drawing plane.

The mast profile 12 comprises as mast parts a front wall 14, two side walls 16 and a rear wall 18, which are welded together to form the mast profile 12, which is rectangular in cross-section. In the corner areas between the side walls 16 and the front wall 14, two laterally projecting high guide profiles 22 are inserted and welded on, which form a linear guide 20 along the front wall 14 for a mast carriage or working carriage (not shown).

To stiffen the mast element 10, a first reinforcement element 30 and a second reinforcement element 40 are arranged inside the hollow mast profile 12 and welded to the inner sides of the outer mast profile 12. In this case, the diagonal first reinforcement element 30 is an isosceles plate bent at approximately a right angle, which is welded at its free ends to the respective opposite guide profiles 22. The legs of the folded first reinforcement element 30 are arranged at an angle of approximately 45° to the side walls 16, with one edge area located approximately in the middle of the mast profile 12.

The diagonal second reinforcement element 40 is, on the one hand, attached to the left side wall 16 in a corner area of the latter and, on the other hand, welded to the first reinforcement element 30 in the edge area approximately in the middle of the mast profile 12. This multiple diagonal stiffening, which runs in the longitudinal direction of the mast, achieves a particularly high rigidity of the hollow mast profile 12 and thus of the mast element 10. The reinforcement elements 30, 40 forming individual chambers in the mast profile 12 can also be referred to as longitudinal mast bulkheads. An X-type arrangement may also be provided for higher reinforcement.

In addition, additional longitudinal profiles may be welded to inner sides of the individual mast parts for stiffening purposes, parallel or at right angles to the inner sides, such as a first longitudinal profile 24 on the inner side of the front wall 14 and a second longitudinal profile 26 on an inner side of the rear wall 18, which, among other things, increase the buckling stiffness of the front wall 14 and the rear wall 18.

According to FIG. 2, a construction machine 70 with a carrier device 71 according to the invention is shown. The carrier device 71 comprises an upper carriage 72, which is rotatably mounted on an undercarriage 73, which comprises a crawler chassis.

A substantially vertically oriented mast 74, which comprises a mast element 10 according to the invention, is mounted on the upper carriage 72. Along the mast 74 with the mast element 10, a linear guide 20 is formed for a mast carriage 75. A rotary drive 76 may be mounted on the mast carriage 75. A Kelly bar assembly 100 may be suspended via a support cable 80 that passes over a mast head of the mast 74, and the Kelly bar assembly extends downwardly through the annular rotary drive 76. At a lower end of the Kelly bar assembly 100, a drilling tool not shown, such as a box drill, may be attached to a tool port 98. Via at least one supply line 82, for example, hydraulic fluid may be fed from the carrier device 71 via a suspension device 96 of the Kelly bar arrangement 100 and thus to an attached drilling tool.

For the sake of better understanding of the invention, access holes 77 are indicated along the mast 74, which were mandatory in the prior art for welding on transverse bulkhead plates, but may be omitted in a mast element 10 according to the invention.

The invention claimed is:

1. A mast element for a construction machine, the mast element having an elongate, hollow mast profile, which is approximately rectangular in cross section and comprises a linear guide for a mast carriage on its outer side along a longitudinal direction of the mast element, wherein the mast element comprises a front wall, a rear wall, and two side walls which enclose an inner space, and at least one diagonal reinforcement element extends within the inner space of the mast profile between opposing ones of the front, rear, and side walls along the longitudinal direction of the mast element, which is arranged at an oblique angle to the sides of the approximately rectangular mast profile.

2. The mast element according to claim 1, wherein the at least one reinforcement element is welded along an inner side of the mast profile.

3. The mast element according to claim 2, wherein the at least one reinforcement element is welded along at least two side edges to opposite walls of the mast profile.

4. The mast element according to claim 1, wherein the at least one reinforcement element comprises a plate-shaped metal sheet or a folded metal sheet.

5. The mast element according to claim 1, wherein several reinforcement elements are welded along an inner side of the mast profile.

6. The mast element according to claim 1, wherein the at least one reinforcement element comprises recesses to reduce weight.

7. The mast element according to claim 1, wherein the mast profile is formed by connecting at least two elongate mast parts, wherein connecting joints of the mast parts extend in the longitudinal direction of the mast element.

8. The mast element according to claim 7, wherein the mast parts are formed with flat and/or folded metal sheets and/or profiles.

9. The mast element according to claim 7, wherein the at least one reinforcement element is welded to at least one elongate mast part before the hollow mast profile is closed peripherally by welding on the last elongate mast part.

10. A construction machine comprising a carrier device and a mast attached thereto, wherein the mast comprises at least one mast element according to claim 1.

11. The construction machine according to claim 10, wherein the mast is formed as a a telescopic leader.

12. A method of manufacturing a hollow mast element, wherein during or after the formation of the hollow mast profile in a longitudinal direction of the mast within the mast profile, at least one diagonal reinforcement element is attached at an oblique angle with respect to sides of the approximately rectangular mast profile, wherein a mast element in accordance with claim 1 is formed.

* * * * *